US011406871B2

(12) United States Patent
Kimura et al.

(10) Patent No.: US 11,406,871 B2
(45) Date of Patent: Aug. 9, 2022

(54) ERGOMETER

(71) Applicant: Mitsubishi Electric Engineering Company, Limited, Chiyoda-ku (JP)

(72) Inventors: Yuichi Kimura, Chiyoda-ku (JP); Isao Mizukura, Bunkyo-ku (JP); Kazunori Nosaka, Joondalup (AU)

(73) Assignee: Mitsubishi Electric Engineering Company, Limited, Chiyoda-ku (JP)

( * ) Notice: Subject to any disclaimer, the term of this patent is extended or adjusted under 35 U.S.C. 154(b) by 127 days.

(21) Appl. No.: 16/499,968

(22) PCT Filed: Apr. 26, 2017

(86) PCT No.: PCT/JP2017/016599
§ 371 (c)(1),
(2) Date: Oct. 1, 2019

(87) PCT Pub. No.: WO2018/198241
PCT Pub. Date: Nov. 1, 2018

(65) Prior Publication Data

US 2021/0128983 A1 May 6, 2021

(51) Int. Cl.
*A63B 24/00* (2006.01)
*A63B 22/06* (2006.01)
*A63B 21/005* (2006.01)

(52) U.S. Cl.
CPC ..... *A63B 24/0087* (2013.01); *A63B 22/0605* (2013.01); *A63B 24/0062* (2013.01); *A63B 21/0058* (2013.01); *A63B 2024/0065* (2013.01)

(58) Field of Classification Search
None
See application file for complete search history.

(56) References Cited

U.S. PATENT DOCUMENTS 4,824,104 A * 4/1989 Bloch ..... A63B 21/015 188/134
5,186,695 A * 2/1993 Mangseth ..... A63B 21/0058 73/379.06

(Continued)

FOREIGN PATENT DOCUMENTS

JP 7-308405 A 11/1995
WO WO 93/25281 A1 12/1993
WO WO 2012/120468 A1 9/2012

OTHER PUBLICATIONS

International Search Report dated Aug. 1, 2017 in PCT/JP2017/016599 filed on Apr. 26, 2017.

*Primary Examiner* — Sundhara M Ganesan
*Assistant Examiner* — Shila Jalalzadeh Abyaneh
(74) *Attorney, Agent, or Firm* — Oblon, McClelland, Maier & Neustadt, L.L.P.

(57) ABSTRACT

An ergometer according to this invention comprises pedals rotated by an exerciser, a motor connected to the pedals, and a control device connected to the motor in order to control an operation of the motor, wherein a control mode of the control device for controlling the motor can be switched between a concentric contraction exercise mode, in which the motor is caused to function as a load while the pedals are rotated by the exerciser, and an eccentric contraction exercise mode, in which the motor rotates the pedals so that the exerciser is forced to resist the rotation of the pedals.

6 Claims, 3 Drawing Sheets

(56) References Cited

U.S. PATENT DOCUMENTS

| | | | | | |
|---|---|---|---|---|---|
| 5,244,441 | A * | 9/1993 | Dempster | A63B 23/00 | 482/901 |
| 5,314,390 | A * | 5/1994 | Westing | A63B 21/4034 | 601/36 |
| 5,331,851 | A * | 7/1994 | Parviainen | A61B 5/1107 | 482/133 |
| 5,919,115 | A * | 7/1999 | Horowitz | A63B 21/00181 | 482/901 |
| 2004/0106502 | A1* | 6/2004 | Sher | A63B 21/00178 | 482/8 |
| 2006/0199700 | A1* | 9/2006 | LaStayo | A63B 22/0007 | 482/4 |
| 2013/0345025 | A1* | 12/2013 | van der Merwe | A61H 1/0214 | 482/7 |

* cited by examiner

ERGOMETER

TECHNICAL FIELD

This invention relates to an ergometer having pedals that are rotated by an exerciser.

BACKGROUND ART

Currently, in widely available ergometers, loading means such as a mechanical brake or an electromagnetic brake, for example, is connected to pedals that are pedaled by an exerciser, and by varying the intensity of the load generated by the loading means, the exerciser performs training or evaluates his/her muscular strength (see PTL 1, for example). The load generated by the loading means is equal to or smaller than torque generated by the exerciser. Therefore, the movement direction of the pedals is identical to a vector direction of the torque generated by the muscles in the legs of the exerciser, and as a result, a concentric contraction exercise, in which muscular strength is exerted while causing the muscle fibers to contract, is performed.

In recent years, an eccentric contraction exercise has come to attention as an exercise method for elderly patients with sarcopenia, breathing complaints (in particular, chronic obstructive pulmonary disease), and so on, for example. During the eccentric contraction exercise, muscular strength is exerted while causing the muscle fibers to expand, and therefore a comparatively large exercise load can be applied with low energy consumption. A device on which an exerciser exerts muscular strength in order to resist the rotation of pedals that are driven to rotate by a motor so that exercise is performed while the muscle fibers expand has been developed (see PTL 2, for example).

CITATION LIST

Patent Literature

[PTL 1] Japanese Patent Application Publication No. 2004-173862

[PTL 2] Japanese Patent Application Publication No. 2006-231092

SUMMARY OF INVENTION

Technical Problem

The ergometer of PTL 1 provides only the concentric contraction exercise, while conversely, the device of PTL 2 provides only the eccentric contraction exercise. Therefore, two devices are required to implement both the concentric contraction exercise and the eccentric contraction exercise. Installing two devices is costly and requires a sufficiently large installation area.

This invention has been designed to solve the problem described above, and an object thereof is to provide a single ergometer with which both the concentric contraction exercise and the eccentric contraction exercise can be realized.

Solution to Problem

An ergometer according to this invention comprises pedals rotated by an exerciser, a motor connected to the pedals, and a control device connected to the motor in order to control an operation of the motor, wherein a control mode of the control device for controlling the motor can be switched between a concentric contraction exercise mode, in which the motor is caused to function as a load while the pedals are rotated by the exerciser, and an eccentric contraction exercise mode, in which the motor rotates the pedals so that the exerciser is forced to resist the rotation of the pedals.

Advantageous Effects of Invention

With the ergometer according to the present invention, the control mode of the control device for controlling the motor can be switched between the concentric contraction exercise mode, in which the motor is caused to function as a load while the pedals are rotated by the exerciser, and the eccentric contraction exercise mode, in which the motor rotates the pedals so that the exerciser is forced to resist the rotation of the pedals, and therefore the concentric contraction exercise and the eccentric contraction exercise can both be realized by a single ergometer.

DESCRIPTION OF EMBODIMENTS

An embodiment of this invention will be described below with reference to the drawings.

First Embodiment

Figure 1:
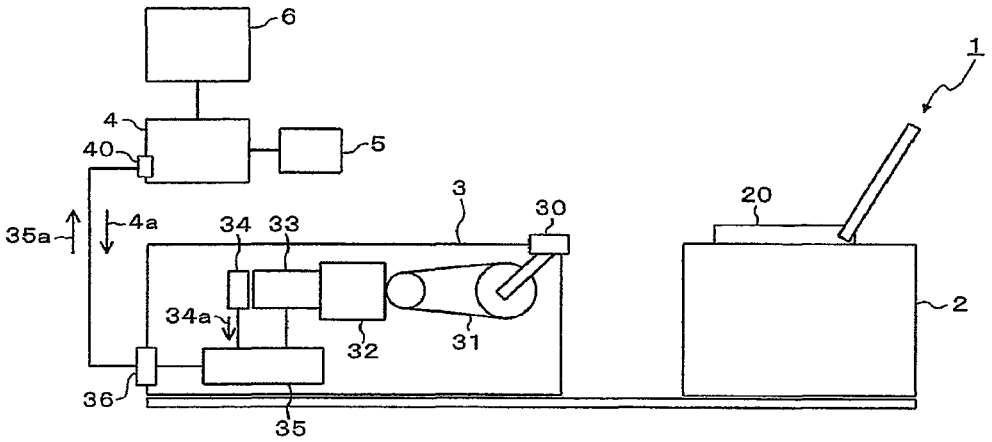
FIG. 1 is a view showing a configuration of an ergometer according to a first embodiment of this invention.

FIG. 1 is a view showing a configuration of an ergometer according to a first embodiment of this invention. As shown in FIG. 1, an ergometer 1 comprises a seat portion 2, an ergometer main body 3, an information processing device 4, an input device 5, and a display device 6.

The seat portion 2 has a seat surface 20 on which an exerciser sits. The exerciser sitting on the seat surface 20 can rotate pedals 30 of the ergometer main body 3 using his/her legs extended forward.

The ergometer main body 3 comprises the pedals 30, a transmission member 31, a reduction gear 32, a motor 33, an angle detector 34, a motor control device 35, and a communication interface 36.

The pedals 30 are rotated by the exerciser sitting on the seat surface 20 and are connected to the motor 33 through the transmission member 31 and the reduction gear 32. The transmission member 31 is constituted by a chain, a belt, or the like, for example. The reduction gear 32 is constituted by a plurality of gears or the like. The reduction gear 32 decelerates the output of the motor 33. The operation of the pedals 30 by the exerciser is transmitted to the motor 33 through the transmission member 31 and the reduction gear 32. Similarly, the output of the motor 33 during power running and a braking force (a load) generated by the motor 33 during regeneration are transmitted to the pedals 30 through the transmission member 31 and the reduction gear 32. Note that the reduction gear 32 is used to obtain an appropriate rotation speed and an appropriate torque when a rated rotation speed of the motor 33 is too high relative to an envisaged rotation speed of the pedals 30 or the like. Depending on the characteristics of the motor 33, the reduction gear 32 may be omitted.

The angle detector 34 is constituted by an encoder or the like, for example. The angle detector 34 detects the rotation angle (the angular position of a rotary shaft) of the motor 33. The motor 33 and the angle detector 34 are connected to the motor control device 35.

The information processing device 4 is connected to the motor control device 35 through the communication interface 36. The motor control device 35 controls the operation of the motor 33 on the basis of a control command 4*a* issued from the information processing device 4 and angle information 34*a* issued from the angle detector 34.

The information processing device 4 is constituted by a personal computer or the like, for example. The information processing device 4 is connected to the motor control device 35 through the communication interface 40. The information processing device 4 controls the operation of the motor 33 via the motor control device 35. In other words, in the ergometer according to this embodiment, the motor control device 35 and the information processing device 4 constitute a control device for controlling the operation of the motor 33. As will be described in further detail below, the information processing device 4 is capable of monitoring the operating condition of the motor 33 on the basis of control information 35*a* issued from the motor control device 35 and obtaining exercise load data from the operating condition of the motor 33. The exercise load data are information representing the load strength (the muscular strength) generated by the legs of the exerciser while rotating the pedals 30, and more specifically information representing the torque or wattage (the work rate) generated by the legs of the exerciser at each rotation angle.

The input device 5 is constituted by an operating button, a touch panel, or the like, for example. The input device 5 is connected to the information processing device 4. The input device 5 inputs information into the information processing device 4 when operated by the exerciser. The information processing device 4 can modify the control of the motor 33 on the basis of the information issued from the input device 5.

The display device 6 is constituted by a liquid crystal display or the like, for example. The display device 6 is connected to the information processing device 4. The display device 6 displays information input from the information processing device 4. The information displayed on the display device 6 will be described in detail below.

Here, in the ergometer according to this embodiment, a control mode in which the motor control device 35 and the information processing device 4 control the motor 33 can be switched between a concentric contraction exercise mode and an eccentric contraction exercise mode. The control mode is switched on the basis of the input from the input device 5.

The concentric contraction exercise mode is a control mode for causing the motor 33 to function as a load while the pedals 30 are rotated by the exerciser. The motor 33 can be caused to function as a load by causing the motor 33 to execute a regenerative operation while the pedals 30 are rotated by the exerciser. The power generated by the motor 33 during the regenerative operation is consumed by a regenerative resistor, not shown in the figure. By controlling the amount of the power consumed by the regenerative resistor, the size of the load (the braking force) generated by the motor 33 can be adjusted, and as a result, a target exercise intensity can be realized. The amount of the power consumed by the regenerative resistor is calculated from a value obtained by subtracting a torque component generated by a dynamic friction in the transmission mechanism from the torque generated by the exerciser.

The concentric contraction exercise mode can be realized by executing an isokinetic control, in which the speed of a rotation motion (a bicycle motion) achieved by the pedals 30 is kept constant by controlling the load exerted on the pedals 30. In the isokinetic control, a reference rotation speed of the pedals 30 (a reference rotation speed of the motor 33) is set. Then, when the actual rotation speed of the pedals 30 is lower than the reference speed, the load generated by the motor 33 is reduced, making the pedals 30 easier to pedal, in order to increase the speed of the pedals 30, and when the actual rotation speed of the pedals 30 equals or exceeds the reference speed, the load generated by the motor 33 is increased, making the pedals 30 harder to pedal. Thus, the pedaling speed of the pedals 30 is guided so as to remain constant.

In the concentric contraction exercise mode, in order to increase the speed when the speed falls below the reference speed, the load is adjusted so as to reduce the load applied up to that point. The reduced load corresponds to a difference between the muscular strength exerted by the exerciser to pedal the pedals 21 up to that point and the muscular strength exerted by the exerciser after the load is reduced. The sum of the reduced load and the reference load equals the muscular strength exerted by the exerciser immediately prior to reduction of the load. By comparing measured muscular strength data with the angle information 34*a* issued from the angle detector 34, the variation in the muscular strength of the exerciser at each rotation angle of the pedals 30 can be ascertained. The information processing device 4 obtains the measured muscular strength data as exercise load data while controlling the motor 33 in the concentric contraction exercise mode. Storage of the exercise load data in the concentric contraction exercise mode is also disclosed in Japanese Patent Application Publication No. 2001-276275.

The eccentric contraction exercise mode is a control mode in which the motor 33 rotates the pedals 30 so as to cause the exerciser to resist the rotation of the pedals 33. The control of the motor 33 in the eccentric contraction exercise mode will be described below.

Figure 2:
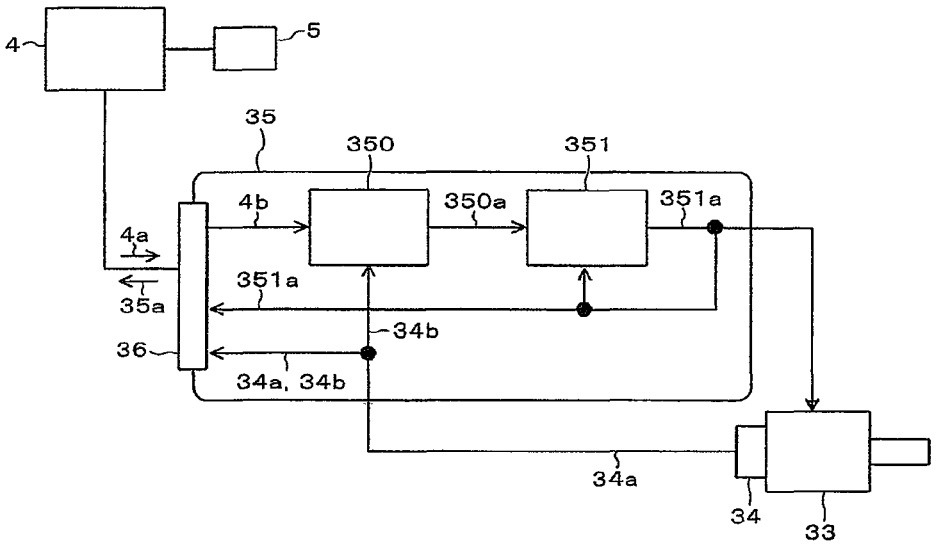
FIG. 2 is a block diagram showing control blocks of a motor control device of FIG. 1.

FIG. 2 is a block diagram showing control blocks of the motor control device 35 of FIG. 1. As shown in FIG. 2, the motor control device 35 receives the control command 4*a* issued from the information processing device 4 and the angle information 34*a* issued from the angle detector 34. The control command 4*a* includes a speed command 4*b* specifying the rotation speed of the rotary shaft of the motor 33. The angle information 34*a* is input in real time. The motor control device 35 obtains an angle variation over a fixed time, i.e. an actual motor speed value 34*b*, on the basis of the angle information 34*a*.

The motor control device 35 comprises a speed processing routine 350 and a current control routine 351. The speed processing routine 350 compares the speed command 4*b* with the actual motor speed value 34*b*, and generates and outputs a current command 350*a* so that the difference between the actual speed of the motor 33 and the command speed 4*b* reaches 0.

The current control routine 351 supplies a current 351*a* to the motor 33 on the basis of the current command 350*a* issued from the speed processing routine 350. The current control routine 351 adjusts the size of the current 351*a* so that the difference between the value of the current 351*a* actually supplied to the motor 33 and the current command 350*a* reaches 0.

The control of the motor 33 in the eccentric contraction exercise mode can be achieved by fixing the rotation speed of the rotary shaft of the motor 33 at a fixed value using the speed command 4*b*. In other words, when the exerciser presses the pedals 30, a commensurate reactive force is immediately generated so that a constant speed is maintained. This reactive force is exerted on the legs of the exerciser, and as a result, an eccentric contraction exercise is realized. A motor that is capable of generating a considerably larger force than the pedal pressing force of the exerciser is used as the motor 33. In this mode, the motor 30 is in a power running operation. Further, the current value flowing through the motor 30 is calculated from a value obtained by adding the torque component generated by a dynamic friction in the transmission mechanism to the torque generated by the exerciser.

In the eccentric contraction exercise mode, the current 351*a*, which is of a commensurate size to the pedal pressing force of the exerciser, is supplied to the motor 33. The angle information 34*a* issued from the angle detector 34, the actual motor speed value 34*b* obtained from the angle information 34*a*, and the value of the current 351*a* supplied to the motor 33 by the current control routine 351 are input into the information processing device 4 as the control information 35*a*. In the eccentric contraction exercise mode, the information processing device 4 can obtain the muscular strength (the exercise load data) of the exerciser at each rotation angle of the pedals 30 by comparing the angle information 34*a* with the current 351*a*.

Figure 3:
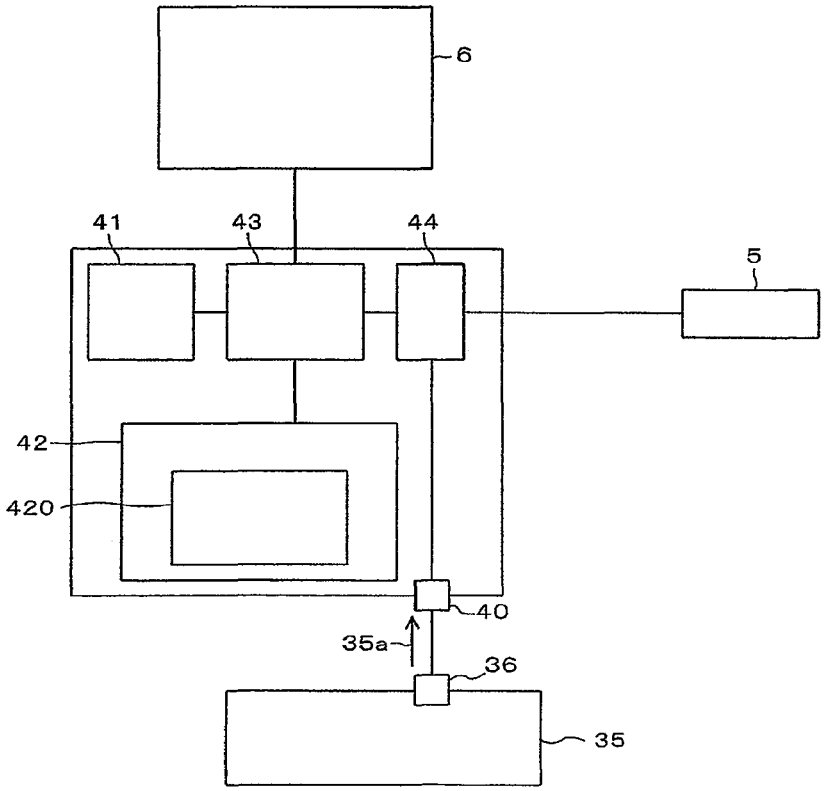
FIG. 3 is a block diagram showing an internal configuration of an information processing device of FIG. 2.
Figure 4:
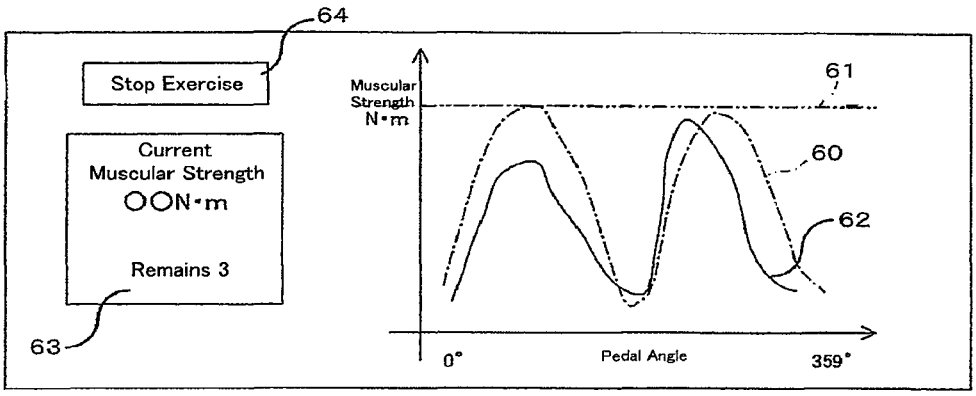
FIG. 4 is an illustrative view showing an example of a screen displayed on a display device 6 of FIG. 2 during an eccentric contraction exercise.

Next, FIG. 3 is a block diagram showing an internal configuration of the information processing device 4 of FIG. 2. FIG. 4 is an illustrative view showing an example of a screen displayed on the display device 6 of FIG. 2 during the eccentric contraction exercise.

As shown in FIG. 3, the information processing device 4, while controlling the motor 33 in at least one of the eccentric contraction exercise mode and the contraction exercise mode, receives the control information 35*a* which includes the angle information 34*a*, the actual motor speed value 34*b* and the value of the current 351*a*, through the communication interface 40. The information processing device 4 multiplies the value of the current 351*a* by a predetermined coefficient so that the value of the current 351*a* is converted into a load value, the unit of which is N/m or kgf or the like, for example. Further, the information processing device 4 successively stores the value of the current 351*a*, converted into the load, and the angle information 34*a* in a memory 41. As a result, the muscular strength (the exercise load data) of the exerciser at each rotation angle of the pedals 30 is successively stored in the memory 41. These processing are performed by causing a CPU 43 to execute a program 420 stored in a fixed storage device 42 inside the information processing device 4.

At the start of the eccentric contraction exercise, the exerciser sits on the seat surface 20 (see FIG. 1), places his/her feet on the pedals 30, and performs an exercise start operation using the input device 5. In response to this exercise start operation, a start signal is input into the CPU 43 from the input device 5 through an input/output unit 44. In response to this start signal, the CPU 43 starts to control the motor 33 in accordance with the eccentric contraction exercise mode. That is, the pedals 30 are rotated at a fixed rotation speed. The exerciser exercises by trying to stop the rotating pedals 30.

While controlling the motor 33 in accordance with the eccentric contraction exercise mode, the CPU 43 displays data on the display device 6. The data are obtained by multiplying a coefficient by exercise load data which are generated during the concentric contraction exercise and are stored in the fixed storage device 42.

As described in "New concepts for exercise load devices—The outlook for treadmills and ergometers, The Japanese Journal of Physical Therapy, 33(6), 387-393, June 1999" and so on, one feature of measurement of the muscular strength (exercise load data) of an exerciser performing a concentric contraction exercise is extremely high reproducibility, enabling easy implementation. Even when the exerciser is not accustomed to an eccentric contraction exercise, variance between the measurement data obtained at each angle during measurements performed over a plurality of rotations is small. By showing an exerciser who is unaccustomed to eccentric contraction exercise data obtained by multiplying a coefficient by data generated during a concentric contraction exercise, a target exercise load can be presented to the exerciser.

The data which displayed on the display device 6 and are obtained by multiplying the coefficient by the exercise load data generated during the concentric contraction exercise may be data for each angle, as shown by a first curve 60 indicated by a dot-dash line in FIG. 4, or data for a maximum value only, as shown by a straight line 61 indicated by a dot-dot-dash line in FIG. 4. The first curve 60 can be obtained by multiplying the coefficient by the values of the exercise load data generated at each angle during the concentric contraction exercise. The straight line 61 can be obtained by multiplying the coefficient by the maximum value of the exercise load data generated within a single rotation of the pedals during the concentric contraction exercise. The coefficient can be set at a fixed value that is not dependent on the angular position of the pedals 30, such as 0.6, for example.

While controlling the motor 33 in accordance with the eccentric contraction exercise mode, the information processing device 4 converts the value of the received current 351*a* into the load value and stores the converted value in the memory 42 together with the angle information 34*a* and the actual motor speed value 34*b* received simultaneously.

Further, while controlling the motor 33 in accordance with the eccentric contraction exercise mode, the information processing device 4 displays the current exercise load on the display device 6 in the form of a second curve 62 indicated by a solid line in FIG. 4. The current exercise load is updated successively. By displaying the second curve 62 indicating the current exercise load on the display device 6 in addition to the first curve 60 and/or the straight line 61 indicating the target exercise load, the exerciser can be shown the difference between the target exercise load and the exercise load currently being exerted, and can thereby be prompted to exert the target exercise load more reliably.

The display device 6 is also capable of displaying, as auxiliary information, a window 63 indicating a numerical value of the current muscular strength, a numerical value of a target muscular strength, the remaining number of pedal rotations, and so on. An exercise stop button 64 for interrupting the exercise can also be displayed on the screen of the display device 6.

Figure 5:
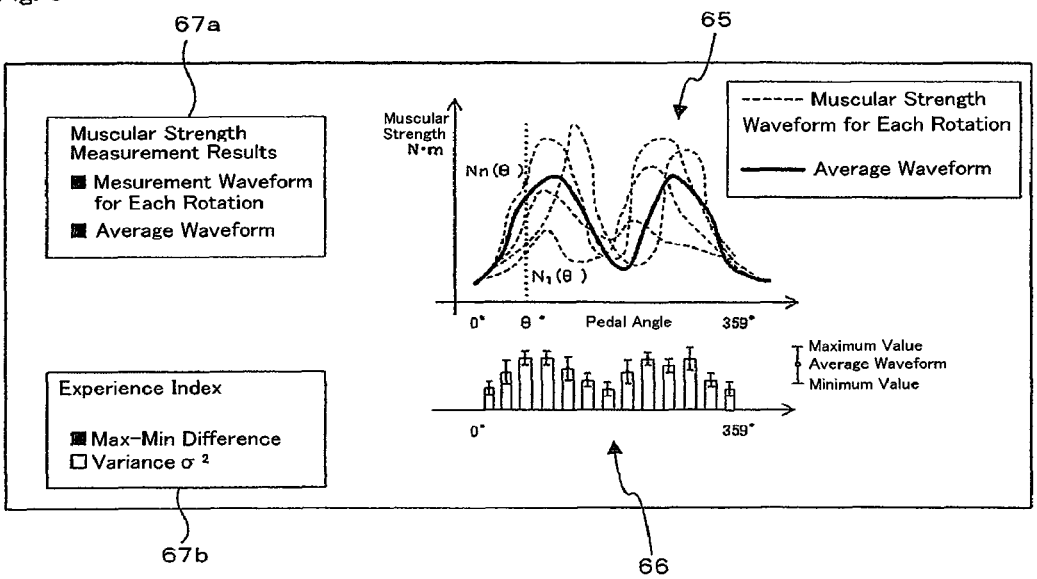
FIG. 5 is an illustrative view showing an example of a muscular strength measurement result screen displayed on the display device 6 of FIG. 2 after the eccentric contraction exercise.

Next, FIG. 5 is an illustrative view showing an example of a muscular strength measurement result screen displayed on the display device 6 of FIG. 2 following the eccentric contraction exercise.

The eccentric contraction exercise is completed when the pedals 30 have been rotated a number of times predetermined by the program or a number of times preset by the exerciser. When the eccentric contraction exercise is completed, the information processing device 4 creates evaluation data by processing the information stored in the memory 42 during the eccentric contraction exercise. As the evaluation data, data obtained by averaging the load strength (the torque or wattage) generated by the exerciser over a plurality of rotations for each angle, and data indicating variation in the load strength generated by the exerciser can be created. As the data indicating the variation, a maximum value, a minimum value, and an average value at each angle over a plurality of rotations during the exercise, the standard deviation and variance of the data at each angle, and the total variance and total standard deviation of all of the data obtained over the plurality of rotations, which are obtained by adding together the total variance of all angles, can be created. Not all of these data have to be created as the data indicating variation, and at least one thereof may be created as required.

An example of a method for determining the variance of an entire waveform will now be described. The method is described below using a case in which muscle strength measurements are performed N times. First, as shown in FIG. 5, the square of a variance VAR $(\theta)=\Sigma$ (i=1, N) (Ni $(\theta)-\mu$ (N $(\theta)$) between an $i^{th}$ muscular strength measurement Ni $(\theta)$ at an angle $\theta$ and an average value $\mu$ $(N(\theta))$ of the muscular strength measurement at the angle $\theta$ is calculated, whereupon a sum VAR=$\Sigma$ ($\theta$=1, 360) VAR $(\theta)$ is obtained over all angles. In so doing, the variance of an entire waveform can be calculated. This variance decreases as the exercise becomes accustomed to the eccentric contraction exercise.

In FIG. 5, the information processing device 4 displays a graph 65 of a muscular strength variation waveform for each rotation of the pedals 30 and an average waveform thereof on the screen of the display device 6 as a muscular strength measurement result. Further, the information processing device 4 displays an averaged graph 66 of each angle as the data indicating variation in the load strength generated by the exerciser. The maximum value, the minimum value, and the average value are displayed in the form of a key shown on the right side of the averaged graph 66. Display item selection windows 67*a* and 67*b* are provided on the screen of the display device 6 so that a user can freely select the content to be displayed. The types of data to be displayed can be selected as desired. A plurality of types of data may be displayed simultaneously. During the eccentric contraction exercise, the force for resisting the pedals is dependent on the exerciser. Therefore, when the exerciser is unaccustomed to the eccentric contraction exercise, the force for resisting the pedals may vary greatly from rotation to rotation. The exerciser or a trainer can reconsider the experience of the exerciser and the appropriateness of the target value through the size of the variation in the muscular strength exerted during the exercise by referring to the displayed waveforms and numerical values.

The measurement results are stored in a storage device built into or externally connected to the information processing device 4. Hence, when the eccentric contraction exercises are performed a plurality of times with time intervals therebetween, data recorded in the past can be arranged in time series, and change over time can be confirmed by regarding the total variance or the total standard deviation of all angles as a degree of training experience. The aforementioned storage device denotes a hard disk, a nonvolatile memory, or the like, for example, that stores information even after a power supply of the information processing device 4 is cut off. Information (at least the time and date of the exercise and an ID) identifying the exerciser is included in the stored data together with the exercise results, and information indicating illness and the physical condition of the exerciser on the relevant day can be attached as required. Here, the time and date of the exercise, the ID, and the information indicating illness and the physical condition of the exerciser on the relevant day can be input by the exerciser or the person guiding the exercise before storing data using input means 5 connected to the information processing device 4.

Figure 6:
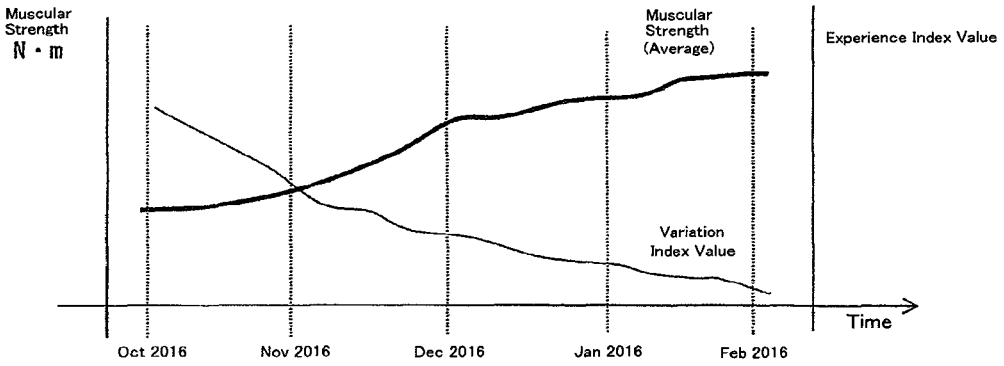
FIG. 6 is a view showing an example of a screen showing respective transitions of the muscular strength measurement result and a degree of variation.

FIG. 6 is an illustrative view showing an example of a data transition screen displayed on the display device 6 of FIG. 2 after the eccentric contraction exercise. As shown in FIG. 6, the information processing device 4 has a function for reading the stored data and displaying a transition of the data in time series.

When the control mode is set in the eccentric contraction exercise mode, the information processing device 4 obtains the exercise load data generated during the eccentric contraction exercise from the operating condition of the motor and displays on the display device 6 the transition of at least one of the maximum value, the minimum value, and the average value of the exercise load data for each rotation of the pedals. In FIG. 6, the transition of the average value of the exercise load data is displayed.

The information processing device 4 can also display the transition of the data indicating variation. As described above, the data indicating variation, the transition of which is displayed, include at least one of the maximum value, minimum value, and average value at each angle over a plurality of rotations during the exercise, the standard deviation and variance of the data at each angle, and the total variance and total standard deviation of all of the data obtained over the plurality of rotations, which are obtained by adding together the total variance of all angles. By checking this display, the muscular strength measurement result and the degree of exercise experience can be visually confirmed.

In this ergometer 1, the control mode in which the control device (the motor control device 35 and the information processing device 4) controls the motor 33 can be switched between the concentric contraction exercise mode, in which the motor 33 is caused to function as a load while the exerciser rotates the pedals 30, and the eccentric contraction exercise mode, in which the motor 33 rotates the pedals 30 so that the exerciser is forced to resist the rotation of the pedals 30. Therefore the concentric contraction exercise and the eccentric contraction exercise can both be realized using the single ergometer. As a result, the required cost and installation area can be suppressed in comparison with a case where two devices, namely a device that provides only a concentric contraction exercise and a device that provides only an eccentric contraction exercise, are installed.

Further, when the control mode is set in the concentric contraction exercise mode, the control device obtains the exercise load data generated during the concentric contraction exercise from the operating condition of the motor 33, and when the control mode is set in the eccentric contraction exercise mode, the control device displays data obtained by multiplying the coefficient by the exercise load data generated during the concentric contraction exercise on the display device 6. As a result, a target training effect can be obtained more reliably. More specifically, if exercise load data are obtained by a device that provides only a concentric contraction exercise and the obtained exercise load data are used in a device that provides only an eccentric contraction exercise, the exercise loads displayed on the respective devices may diverge due to differences in the machines used to detect the exercise loads. When such a divergence occurs, training is performed on the basis of load strengths having different references, and as a result, it may be impossible to realize the target training effect. With a configuration such as that of the ergometer 1 according to this embodiment, this problem can be solved.

Furthermore, when the control mode is set in the eccentric contraction exercise mode, the control device obtains the exercise load data generated during the eccentric contraction exercise from the operating condition of the motor 33, and displays the exercise load data generated during the eccentric contraction exercise on the display device 6, in addition to the data obtained by multiplying the coefficient by the exercise load data generated during the concentric contraction exercise. The exerciser can thus be shown the difference between the target exercise load and the exercise load currently being exerted and can thereby be prompted more reliably to exert the target exercise load.

Moreover, the data obtained by multiplying the coefficient by the exercise load data generated during the concentric contraction exercise are calculated by multiplying the coefficient by the maximum value of the exercise load data generated within a single rotation of the pedals during the concentric contraction exercise. Therefore display can be simplified, enabling easy measurement even when unaccustomed to the eccentric contraction exercise. As a result, an effective target value avoiding exercise that places an excessive load on the exerciser can be set.

Further, when the control mode is set in the eccentric contraction exercise mode, the control device obtains the exercise load data generated during the eccentric contraction exercise from the operating condition of the motor 33 and displays on the display device 6 at least one of the average value and the variance value of at least one of the maximum value, minimum value, and average value of the exercise load data generated within each rotation of the pedals over a plurality of pedal rotations. As a result, at least one of the training effect and the degree of experience of the eccentric contraction exercise can be confirmed.

Furthermore, when the control mode is set in the eccentric contraction exercise mode, the control device obtains the exercise load data generated during the eccentric contraction exercise from the operating condition of the motor 33 and displays on the display device the transition of at least one of the maximum value, minimum value, and average value of the exercise load data for each rotation of the pedals, and as a result, the training effect can be confirmed.

INDUSTRIAL APPLICABILITY

According to this invention, a target value of an eccentric contraction exercise can be set and evaluated so that a person with low physical strength or a patient with breathing difficulties can improve his/her muscular strength while expending little energy. On the basis of the result, a trainer can plan a more appropriate training program for the exerciser.

The invention claimed is:

1. An ergometer comprising:

pedals rotated by an exerciser;

a motor connected to the pedals; and a controller connected to the motor in order to control an operation of the motor, wherein a control mode of the controller for controlling the motor can be switched between a concentric contraction exercise mode, in which the motor is caused to function as a load while the pedals are rotated by the exerciser, and an eccentric contraction exercise mode, in which the motor rotates the pedals so that the exerciser is forced to resist the rotation of the pedals, when the control mode is set in the concentric contraction exercise mode, the controller obtains exercise load data generated during a concentric contraction exercise based on an operating condition of the motor, when the control mode is set in the eccentric contraction exercise mode, the controller displays data indicating a target value of an eccentric contraction exercise, which is based on the exercise load data generated during the concentric contraction exercise, on a display device, and when the control mode is set in the eccentric contraction exercise mode, the controller displays data obtained by multiplying a coefficient by the exercise load data generated during the concentric contraction exercise on the display device.

2. The ergometer of claim 1, wherein, when the control mode is set in the eccentric contraction exercise mode, the controller obtains exercise load data generated during the eccentric contraction exercise from the operating condition of the motor, and displays the exercise load data generated during the eccentric contraction exercise on the display device, in addition to the data obtained by multiplying the coefficient by the exercise load data generated during the concentric contraction exercise.

3. The ergometer of claim 2, wherein the data obtained by multiplying the coefficient by the exercise load data generated during the concentric contraction exercise are calculated by multiplying the coefficient by a maximum value of the exercise load data generated within a single rotation of the pedals during the concentric contraction exercise.

4. The ergometer of claim 1, wherein the data obtained by multiplying the coefficient by the exercise load data generated during the concentric contraction exercise are calculated by multiplying the coefficient by a maximum value of the exercise load data generated within a single rotation of the pedals during the concentric contraction exercise.

5. The ergometer of claim 1, wherein, when the control mode is set in the eccentric contraction exercise mode, the controller obtains exercise load data generated during the eccentric contraction exercise from the operating condition of the motor and displays on the display device at least one of a maximum value, a minimum value, an average value, a variance, and a standard deviation, and a total variance and a total standard deviation of all angles in relation to the exercise load data generated within each rotation of the pedals over a plurality of pedal rotations.

6. The ergometer of claim 1, wherein, when the control mode is set in the eccentric contraction exercise mode, the controller obtains exercise load data generated during the eccentric contraction exercise from the operating condition of the motor and displays on the display device a transition of at least one of a maximum value, a minimum value, an average value, a variance, and a standard deviation, and a total variance and a total standard deviation of all angles in relation to the exercise load data for each rotation of the pedals.

* * * * *